US006104319A

United States Patent [19]

Shpater

[11] Patent Number: 6,104,319

[45] **Date of Patent: *Aug. 15, 2000**

[54] DATA ENTRY KEYPAD ASSEMBLY

[75] Inventor: Pinhas Shpater, Ville St. Laurent, Canada

[73] Assignee: Shmuel Hershkovitz, Quebec, Canada; a part interest

[ * ] Notice: This patent is subject to a terminal disclaimer.

[21] Appl. No.: 09/018,309

[22] Filed: Feb. 3, 1998

Related U.S. Application Data

[62] Division of application No. 08/685,803, Jul. 24, 1996, Pat. No. 5,721,542.

[51] Int. Cl.[7] ..... G08D 25/00

[52] U.S. Cl. ..... 341/23; 340/825.69; 340/525

[58] Field of Search ..... 341/23, 22; 340/525, 340/825.69, 825.72; 345/173, 170, 172; 200/310

[56] References Cited

U.S. PATENT DOCUMENTS

| | | | |
|---|---|---|---|
| 3,662,342 | 5/1972 | Hedin et al. | 340/825.31 |
| 3,681,552 | 8/1972 | Bailey | 200/295 |
| 4,016,561 | 4/1977 | Parker et al. | 340/815.48 |
| 4,131,777 | 12/1978 | Bailey et al. | 200/311 |
| 4,728,936 | 3/1988 | Guscott et al. | 340/525 |
| 5,264,825 | 11/1993 | Schneider | 340/426 |

*Primary Examiner*—Michael Horabik
*Assistant Examiner*—Albert K. Wong
*Attorney, Agent, or Firm*—Burns, Doane, Swecker & Mathis, L.L.P.

[57] ABSTRACT

A data entry keypad assembly is provided for a system controlling a plurality of components. The keypad assembly includes a plurality of key zones arranged in an ordered matrix and each having a label identifier, and a plurality of key switches, provided in corresponding key zones. The keypad assembly also includes a plurality of light source means, each one of the light source means also provided in the corresponding key zones. Input controller connected to the key switches is provided for receiving data in the form of a sequence of key presses of the switches, and information displaying controller connected to the light indicator is provided for indicating a state of some of the components each associated with some of the label identifiers. When the data entry keypad assembly is used for a security system, it controls a plurality of detectors and warning devices, and displays a detection state of the detectors, while allowing activating/deactivating commands to be entered.

6 Claims, 2 Drawing Sheets

DATA ENTRY KEYPAD ASSEMBLY

This application is a divisional, of application Ser. No. 08/685,803, filed Jul. 24, 1996 now U.S. Pat. No. 5,721,542.

FIELD OF THE INVENTION

The present invention relates to a data entry keypad assembly for a system controlling a plurality of components. More particularly, the data entry keypad assembly is for a system controlling a plurality of components having operational states which are displayed by an array of lights, such as for example a security system controller connected to a plurality of detectors and sensors.

BRIEF DESCRIPTION OF THE PRIOR ART

Known in the art, there is U.S. Pat. No. 5,264,825 to Schneider describing a combined switch and indicator light assembly for an electronic vehicle security system. This security system includes a central controller having a plurality of sensors connected thereto. These sensors are located throughout the vehicle and generate signals sent to the controller when an intrusion attempt into the vehicle is detected. The security system is armed by using the aforesaid switch. When armed, the light indicator of the combined switch and indicator light assembly is on, and when the indicator light is off the system is disarmed. Also, in response to the signals generated by the sensors, the controller activates an alarm device and indicates the intrusion attempt by flashing the indicator light. This flashing indicates that the intrusion attempt was detected during the owner's absence.

The switch of the combined switch and indicator light assembly exclusively disables the whole security system, and individual component detector information is neither displayed nor controlled.

Also known in the art are office telephone systems wherein an arrangement of keys and associated LEDs serve for indicating the state of all telephone lines (i.e. busy or free), and for directly connecting the user to the free line desired when an associated key is pressed. An example is the Inter-tel®mpk $_{II}$ by Inter-tel Equipment Inc. of Phoenix, Ariz. The illuminated keys of such a conventional system cannot be used to enter data, program the system or dial any number.

In the field of security system controllers, conventional numeric keypads are provided which may include additional function keys and may be provided with backlighting in order to facilitate security code entry in dim lighting. The protected zones of the security system are represented by individual LEDs provided in an area separate and usually adjacent the numeric data entry keypad. Printed or handwritten identifiers may be provided for labelling each of the LEDs by the associated name of the detector zone. For presenting a convenient and inconspicuous control panel, the labelled LEDs are provided on a relatively small area in a condensed matrix. Still, the overall size of the keypad controller is much larger than the required area for the keypad alone.

OBJECTS AND SUMMARY OF THE INVENTION

It is an object of the present invention to provide a data entry keypad assembly for a system controlling a plurality of components having the necessary means by which a user can enter data to control the system and display the state thereof directly on the keypad assembly.

According to the present invention there is provided a data entry keypad assembly for a system controlling a plurality of components. The keypad assembly comprises a plurality of key zones arranged in an ordered matrix and each having a label identifier, and a plurality of key switches, provided in corresponding key zones. The keypad assembly also comprises a plurality of light source means, each one of the light source means also provided in the corresponding key zones. Input controller means connected to the key switches are provided for receiving data in the form of a sequence of key presses of the switches, and state information displaying means connected to the light source means are provided for indicating a state of at least some of the components each associated with at least some of the label identifiers.

According to a preferred feature of the invention, a light source used to identify the state in one of the key zones provides back lighting for the key zone and switch for use in dim lighting. In the case that the light source is an LED, the intensity of the LED may be varied by pulsing the LED with a variable duty cycle.

According to a further preferred feature of the present invention, the keypad assembly is provided with key zones which cover substantially the entire frontal surface area of a control panel with the key switches being enlarged sufficiently to facilitate data entry with minimal error by accidentally missing one key for another. The keypad according to the present invention is preferably smaller than conventional system controller keypads.

As can be understood, the present invention facilitates interactive programming between the system and the user as a result of individual control of the light sources. For example, a light source may be flashed in order to prompt the user to press the associated key in order to receive state information. Non-state related information can also be displayed by sequentially flashing light sources. For example, after a new security code is programmed, the system may sequentially flash the light sources associated with the keys making up the security code to remind the user of the security code chosen and the sequential pattern it forms. It is also possible to enter a command for system information which is stored numerically and can be displayed for confirmation by sequentially flashing numeric keys. For example, in the case that the controller includes a real time clock, the present setting of the real time clock can be displayed by sequentially flashing a series of digits representing the time. Such information display has further advantages. For example, a system having a real time clock can record the time of a state change. In the case of a security alarm controller, the time at which an intrusion detector detected an intrusion can be displayed by sequentially flashing numeric keys in response to a control command entered by the user.

When the data entry keypad assembly according to the present invention is used for a security system, it controls a plurality of detectors and warning devices, and displays a detection state of the detectors, while allowing activating/deactivating commands to be entered.

DETAILED DESCRIPTION OF THE PREFERRED EMBODIMENT

Figure 1:
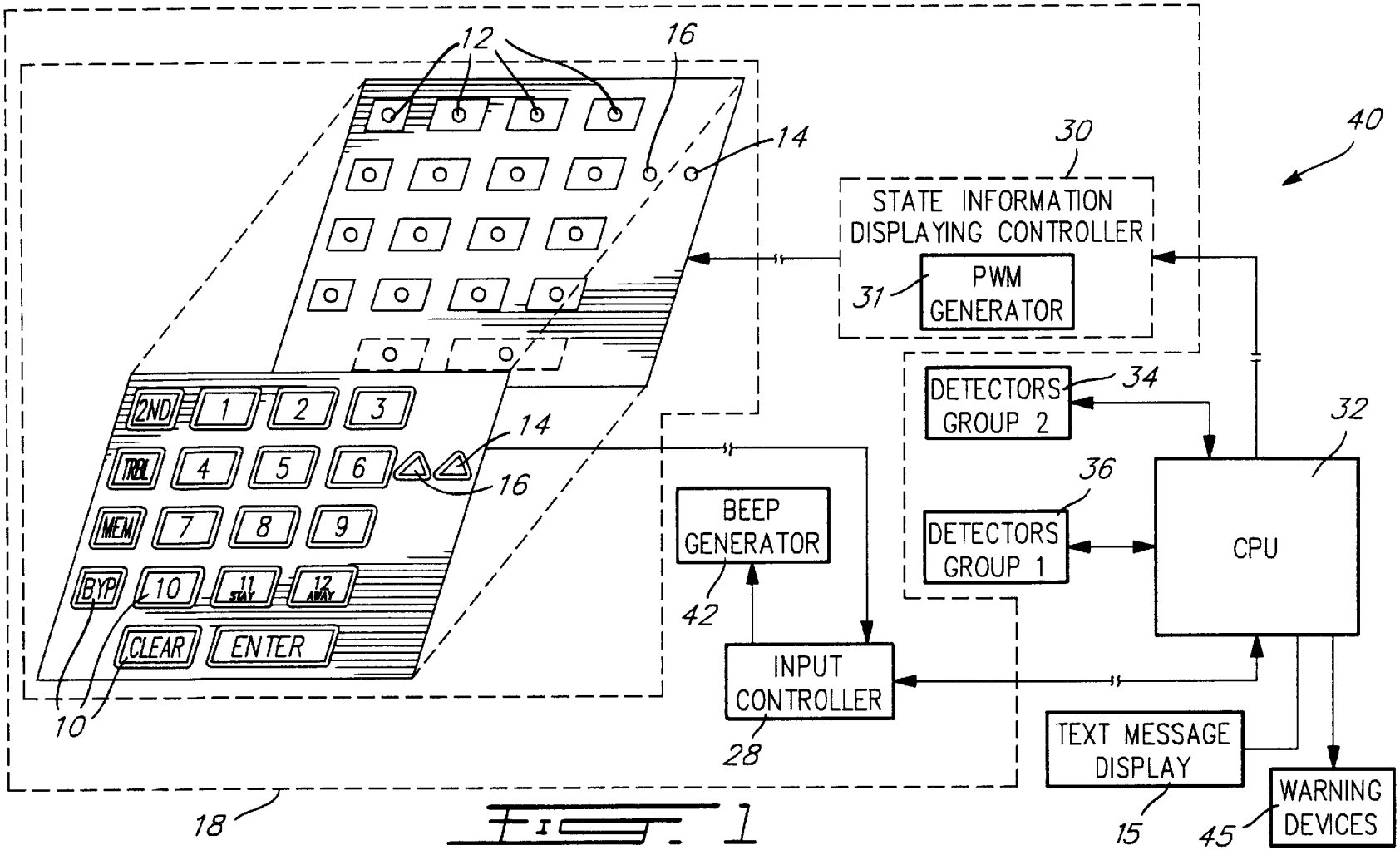
FIG. 1 is a block diagram of a data entry keypad assembly according to the present invention, used in a security system.
Figure 2:
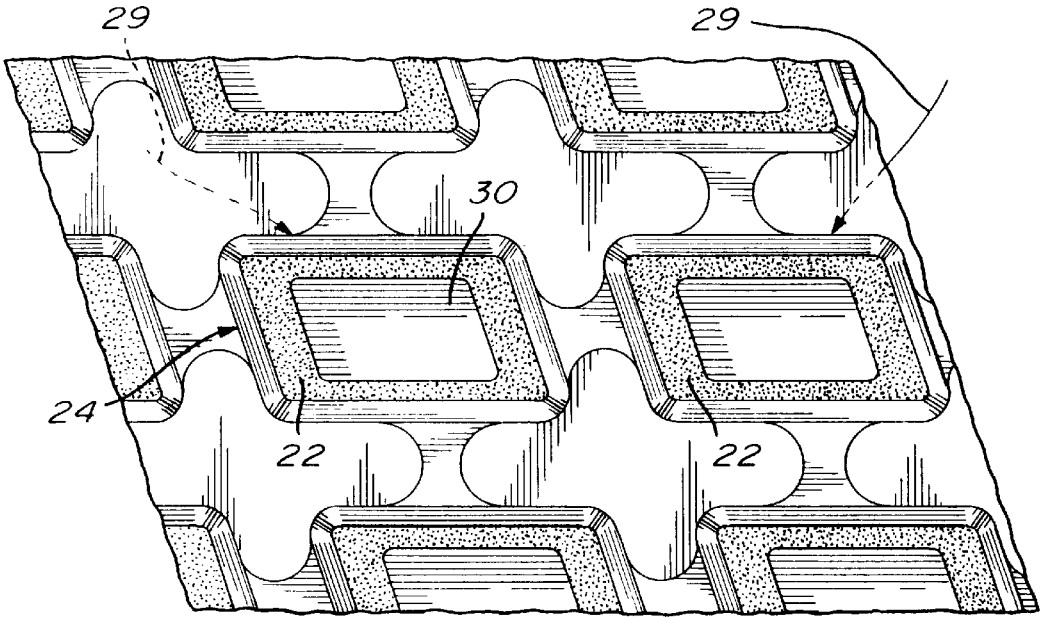
FIG. 2 is a partial back view of a molded silicone keypad block of the data entry keypad assembly.
Figure 3:
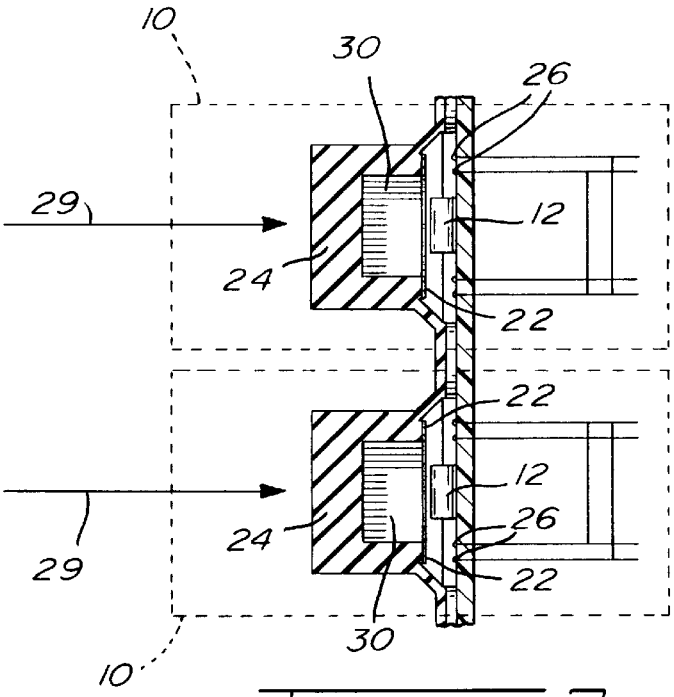
FIG. 3 is a cross section view showing key switches provided in the corresponding key zones of the data entry keypad assembly.

With reference to FIG. 1 to FIG. 3, there is shown a security system data entry keypad assembly 18, connected to CPU 32 for controlling different detectors gathered in two separate groups, numbered 34 and 36, of a security system 40. These detectors can be infrared or microwave motion detectors, smoke detectors and glass break detectors, as well as vibration/shock and door/window contact sensors.

The keypad assembly 18, as shown, is provided with eighteen key zones 10 arranged in an ordered matrix, eighteen key switches 29 and light indicators 12, such as LEDs and more specifically surface mount LEDs, arranged in an ordered matrix in each of the key zones 10. However, other light indicators than the LEDs can be used such as conventional lamps of small sizes. The key switches 29 all have a corresponding label identifier. As shown, the various label identifiers are as follows: 2ND, TRBL, MEM, BYP, CLEAR, ENTER, STAY, AWAY and the numerics 1 to 12. The functions of all of the labeled key switches 29 of the keypad assembly 18 will be described hereinafter.

The eighteen key switches 29 include a molded silicone keypad block having interconnected resilient translucent mobile key elements 24, each having a conductive contact surface 22. Four contact terminals 26 are provided on a surface (not shown), such as a PCB (Printed Circuit Board), on which the surface mount LEDs 12 are mounted and located directly under the corresponding contact surfaces 22. The translucent mobile key elements 24 are each provided with a cavity 30 (see FIG. 2) into which the low profile surface mount LEDs 12 fit when the key elements are depressed. In that way, the LEDs 12 are able to transmit light through a middle of the interconnected mobile key elements 24. Also, each contact surface 22 allows a current to flow across the terminals 26 when the mobile key elements 24 are depressed.

It is worth mentioning that regular LEDs can be mounted onto a LED board (not shown) in an ordered matrix. Moreover, a contact terminal board provided with small apertures aligned with the LEDs, can be mounted onto the LED board so that at least part of each LED projects upwardly from a contact terminal board's surface. In this manner, when the keypad block is mounted on the contact terminal board, at least part of each LED fits into the cavity of each mobile key member.

The keypad assembly 18 is also provided with an input controller 28 connected to the key switches 29 for translating key presses into numerical data and sending the data to the CPU 32. The data received is in the form of a sequence of key presses of the switches 29. The assembly 18 also has an information displaying controller 30 including for example, a matrix of conductors (not shown) connected to the LEDs 12 for turning on individual ones of the LEDs 12. An LCD 15 can also be connected to CPU 32 for indicating the name of a security zone (component of the system) corresponding to a depressed key 29 or an illuminated LED 12. The controller 30 receives light state data from the CPU 32 for indicating a state of the system and of the detectors in the two groups of detectors, 34 and 36. The controller 30 also includes a PWM (Pulse-Width Modulated) generator 31 which pulses the LEDs 12 with a short duty cycle at a frequency appearing continuous, providing a reduced amount of light when the keys 29 are idle to make the key switches 29 visible in low light conditions (i.e. back lighting). The duty cycles of PWM signals are adjustable to adjust the level of the reduced amount of light.

In operation, the user by pressing the key switches 29 sends data, such as an access code or a control command, to the input controller 28 which receives it, and sends it to the CPU 32. For example, by pressing the key switch 29 in a key zone 10 labeled MEM for 2 seconds, and then continuing pressing, the user can alter the level of illumination (the backlighting cycles from dimness to brightness). By stopping the pressing, the user can select the desired level and then press the key switch 29 in the key zone 10 labeled ENTER or CLEAR to save it in the CPU's 32 memory.

The keypad assembly 18 in the preferred embodiment is for security system 40 which can provide coverage for 24 security zones (two groups), such as different locations in a house or a building, divided into the aforesaid two groups, 34 and 36, identified by their numerical labels 1 to 12 for each group. By pressing once or twice the key switch 29 labeled 2ND, the controller 30 is instructed to display the status of the first group of detectors 34 and of the status of the second group of detectors 36 respectively. Furthermore, when the key switch 29 labeled 2ND flashes, this indicates that the 12 security zones of the second group 36 are being displayed.

The security system 40 can be programmed to cover a wide variety of security situations, some of them are described hereinabove.

The first security situation is when the user wants all the security zones to be protected. In order to protect all the security zones, firstly, the light indicator 16 has to be enabled. This light indicator 16 is enabled when all the zones are closed. (All windows and doors have to be closed, and there can be no movement in areas monitored by motion detectors, if such detectors are used). Once the light indicator 16 is on, the user can enter a first predetermined code, and thereafter the key switch in the key zone labeled ENTER (using the code, the security system is programmed to activate all of the detectors in the first or second group of detectors, 34 or 36). If a user makes a mistake in entering the predetermined code, the keypad assembly 18 makes a beep sound by means of a beep generator 42 provided with the keypad assembly 18. Thereafter, he or she must press the key switch in the key zone labeled CLEAR and re-enter the code.

When the code has been correctly entered, the light indicator 14 is enabled, and the light indicator 16 flashes during a delay exit period. This delay exit period is programmed based on the time the user requires to exit the protected area once all of the detectors are activated.

The display screen 15 can also be used to display prompting messages, such as "ENTER PASSCODE", and confirmatory messages such as asterisks as each key of the security or access code is pressed and text messages like "ALL ZONES ACTIVATED" and/or "30 SECONDS UNTIL ACTIVATION, PLEASE EXIT NOW". The display can be changed to count down the remaining delay.

A second security situation is when the user wants to stay on the premises and still be protected. This can be accomplished by pressing the key switch 29 labeled STAY and entering the predetermined code. Using the key switch labeled STAY, the security system 40 is programmed to activate some of the detectors in the group of detectors, 34 or 36, located throughout the premises and to leave others open. The text display 15 can also be used to give instructions, such as "ACTIVATES ONLY SOME ZONES" and "ENTER STAY CODE" when the STAY key is pressed.

A third security situation is when the user wants to manually activate some security zones and leave others open. This is accomplished with a key switch 29 labeled BYP. By pressing this key switch 29 labeled BYP and the predetermined code, the LED 12 in that key zone will illuminate and if the security zones are bypassed the LEDs 12 in the key zones corresponding to the numerical security zones will be illuminated. Thereafter, by pressing once on one of the desired key switches labeled 1 to 12, representing the security zones, the user can leave the corresponding zone open. By pressing the key switch in the same key zone twice, the user can activate the corresponding security zone. Also, as aforesaid, by pressing the key switch labeled 2ND, the controller 30 is instructed to display the status of another group of detectors, and in a same manner the corresponding key switches labeled 1 to 12, representing the second set of security zones, can be used to leave open or to activate the last.

After the user has entered the correct zone bypass information, he has to press a key switch 29 in a key zone labeled ENTER, this will illuminate the key zone labeled BYP thereby indicating that the security zone has been left open. If a mistake was made in entering the number of the selected security zone, the user has to press the key switch 29 in the key zone labeled CLEAR.

A fourth security situation is when the user wants to leave the premises in a hurry and activate the security zones without manually entering security zones to be bypassed. By pressing the key switch in the key zone 10 labeled AWAY and entering a predetermined code, the security system 40 will automatically bypass any open security zones until the exit delay terminates, and thereafter all of the unopened detectors will be activated.

A fifth security situation is when the user wants to activate all of detectors in the two groups of detectors 34 and 36 without entering the predetermined code. This is accomplished by pressing the key switch labeled 10 for 2 seconds.

Now, the key switch labeled MEM, when illuminated, indicates if any alarms were generated while all of the detectors of the security system 40 were activated. A record of all alarm situations that occurred are stored in the security system's 40 memory. By pressing this key switch, after all the security zones have been opened, all the key switches representing the security zones, 1 to 12, where the alarms were generated will be illuminated.

Also, the key switch labeled TRBL, when illuminated, indicates the presence of various trouble conditions. By pressing the key switch labeled TRBL, the last flashes and the key switches labeled 1 to 10 may serve for viewing those trouble conditions. For example, after the key switch labeled TRBL has been pressed, the key switch labeled 1 if illuminated indicates if a battery provided for a back-up current in the event of a power failure is not connected to the security system's control panel 40 including the keypad assembly 18 or should be replaced. The key switch labeled 3, when on, indicates that AC power is not being supplied to the security system's control panel 40 including the keypad assembly 18. The key switch labeled 4 indicates that one of the warning devices 45, such as the siren, is not properly connected to the CPU 32.

Trouble information can also be displayed on the text display 15, such as "SIREN DISCONNECTED" General alarm information can also be displayed on display 15, such as "INTRUDER ALERT". If only one zone detects an intruder, the text message could read "INTRUDER IN: SOUTH ENTRANCE HALL", thus displaying directly the zone name involved in the alarm. However, when more than one zone is triggered, the zone name is displayed only in response to pressing the corresponding zone key 29.

As can be apparent to those skilled in the art various changes can be made to the keypad assembly 18 as described hereinbefore. For example, instead of using the aforesaid input controller 28, the key switches 29 could be directly connected to the CPU 32. In that way, when the user presses the key switches 29, data in the form of the sequence of key presses can be directly send to the CPU 32. Furthermore, instead of using the aforesaid information displaying controller 30, each of the surface mount LEDs 12 of the matrix of LEDs could be individually directly connected to the CPU 32. The latter could send the light state data directly to the individual LEDs 12 for indicating the state of the system 40 and of the detectors in the two group of detectors, 34 and 36. The CPU 32 may also include the PWM generator 31 for pulsing the LEDs 12 to provide the back lighting for the key switches 29.

It is possible to provide two or more keypad assemblies 18 in different locations of a building for the security system 40. Furthermore, the keypad assembly 18 could be provided with additional key switches serving for the same purpose as the key switch labeled 2ND, thereby with only one keypad assembly 18, the security system 40 could provide coverage for more security zones, more specifically 12 extra security zones can be covered per one additional key switch.

Another variant to the keypad assembly 18, as shown in FIG. 1, is the number of key zones 10. For example, the keypad assembly could be provided with a lesser number of key zones, such as 10, or a greater number of key zones, such as 32, depending on the number of functions the user wishes to have, or the number of security zones the user wants to cover.

As can be apparent there are various advantages to the keypad assembly 18 as described hereinabove. Besides being easy to operate, with many functions accessible just by one key press, the keypad assembly is extremely functional, communicates vital security or operational state information directly on the keypad, and thus without the need for an additional matrix display, and is designed in a compact fashion to accommodate any user. Furthermore, the keypad assembly by having an adjustable illumination level, is easily visible especially in emergency situations.

The keypad assembly according to the present invention can also be used for air conditioning or climate control systems in buildings or houses. For this purpose, the key switches of the keypad assembly could be used, for example, to select individual thermostats from a group of thermostats, and to adjust their operating temperatures. Moreover, the keypad assembly could be used for compact telephones for homes or offices. In this case, the key switches could be used to dial the desired telephone numbers and to inform the user of the state of all telephone lines (i.e. busy or free) directly on the keypad. Also, after the user has been informed of the state of all telephone lines, he or she, can be automatically connected to the selected free line by pressing the corresponding key switch. Display 15 could be used to show a number dialed.

In connection to this, the keypad assembly can also be used for bank of elevators. In this case, the key switches can be used for displaying the state of all available elevators (i.e. presently working or disabled), for entering the access code, and selecting the ones the user wishes to turn off or on.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A data entry keypad assembly for a system controlling a plurality of components and for displaying information about a state of said components, the keypad assembly comprising:

a keypad panel having a plurality of key zones arranged in an ordered matrix and each having a numeric component label identifier associated with one of said components;

an integrated set of translucent key switches mounted to said panel in each of said zones, said key switches comprising a plurality of resilient mobile key members, at least one of which having an electrical contact surface;

a light source provided in each one of said key zones;

a plurality of terminal contacts provided on a circuit board surface around each said light source opposite each said electrical contact surface;

a state information display control device connected to each said light source for indicating a state of said components each associated with the label identifiers.

2. The data entry keypad assembly of claim 1, further including a conductive layer provided on a periphery of said contact surface.

3. The data entry keypad assembly of claim 1, wherein said translucent key switches comprise a central cavity receiving said light source when said key switches are depressed.

4. The keypad assembly according to claim 2, wherein each said light source projects upwardly from the circuit board surface into cavities in the mobile key members.

5. The keypad assembly as claimed in claim 4, wherein each said light source comprises light emitting diodes, said diodes being surface mounted on said terminal contacts, a middle of said translucent mobile key members being provided with a cavity into which said light emitting diodes at least partially fit when said key members are depressed.

6. The keypad assembly as claimed in claim 1, further comprising a text display displaying at least one of: a component name of a corresponding key switch being depressed; explanatory information about one of said key switches being depressed; said one of said key switches being a function key; prompt information requesting data entry; and general system information.

* * * * *